United States Patent [19]

Balkau et al.

[11] Patent Number: 4,790,726

[45] Date of Patent: Dec. 13, 1988

[54] RECIPROCATORY PISTON AND CYLINDER MACHINE

[75] Inventors: Guenter K. W. Balkau, Springvale; Eckhard Bez, Moorabbin; John L. Farrant, North Balwyn, all of Australia

[73] Assignee: Commonwealth Scientific and Industrial Research Organization, Victoria, Australia

[21] Appl. No.: 17,405

[22] Filed: Feb. 24, 1987

Related U.S. Application Data

[63] Continuation of Ser. No. 820,585, Jan. 21, 1986, Pat. No. 4,699,572, which is a continuation of Ser. No. 491,967, Apr. 13, 1983, abandoned.

[30] Foreign Application Priority Data

Aug. 13, 1981 [AU] Australia ..... PF0217/81

[51] Int. Cl.[4] ..... F04B 3/00

[52] U.S. Cl. ..... 417/254; 92/212; 92/222; 92/224; 92/248; 417/267; 417/443; 417/493; 417/520; 417/559; 417/DIG. 1

[58] Field of Search ..... 417/565, 559, 443, 493, 417/254, 520, 267, 561; 92/212, 248, 222, 224

[56] References Cited

U.S. PATENT DOCUMENTS

| | | | |
|---|---|---|---|
| 1,399,151 | 12/1921 | Putnam et al. | 417/254 |
| 1,486,793 | 3/1924 | Orton | 417/443 |
| 2,280,317 | 4/1942 | Stehle et al. | 417/520 X |
| 2,836,119 | 5/1958 | Kugler | 417/443 |
| 3,172,340 | 3/1965 | Blenkle | 92/250 |
| 3,212,411 | 10/1965 | Storms | 92/248 |
| 3,704,079 | 11/1972 | Berlyn | 417/443 |
| 3,779,672 | 12/1973 | Schroeder | 417/493 |
| 3,839,946 | 10/1974 | Paget | 417/DIG. 1 |
| 4,143,586 | 3/1979 | Zitting | 92/250 |
| 4,173,433 | 11/1979 | Anderson | 417/254 |
| 4,315,454 | 2/1982 | Knodel | 92/248 |
| 4,376,472 | 3/1983 | Heyer et al. | 92/248 |

FOREIGN PATENT DOCUMENTS

| | | | |
|---|---|---|---|
| 136999 | 8/1979 | Fed. Rep. of Germany | 417/254 |

*Primary Examiner*—Edward K. Look

*Attorney, Agent, or Firm*—Sughrue, Mion, Zinn, Macpeak & Seas

[57] ABSTRACT

A reciprocatory piston and cylinder machine particularly suitable for use as a vacuum pump includes a cylinder (17), a cylindrical piston (16) relatively slidably reciprocable within the cylinder (17), and means for substantially sealing the annular space between the piston (16) and cylinder (17) in lieu of oil or other liquid lubricant. The sealing means comprises a sleeve (102) of a low-friction material disposed under circumferential tension, and preferably also under longitudinal tension, on the cylindrical surface of the piston (16). Also disclosed is a reciprocatory piston and cylinder machine of particular prior construction having a one-way valve (42) in an exhaust port (30) ahead of a head portion (24) of the piston (16). The arrangement is such that, as the front face of the piston head portion (24) approaches the closed cylinder end (52), the piston head portion 24 physically moves the one-way valve (42) so as to open the exhaust port (30).

2 Claims, 3 Drawing Sheets

RECIPROCATORY PISTON AND CYLINDER MACHINE

This is a continuation of application Ser. No. 820,585 filed Jan. 21, 1986 now U.S. Pat. No. 4,699,572 which is a continuation of application Ser. No. 491,697 filed Apr. 13, 1983 now abandoned.

TECHNICAL FIELD

This invention relates to reciprocatory piston and cylinder machines which are oil-free and do not rely on a liquid oil or grease to lubricate and minimize leakage past the piston sealing components. As such, the invention has particular application to oil-free reciprocatory piston and cylinder machines adapted for use as vacuum pumps, especially as backing pumps for high vacuum pumping systems.

Where it is desired to achieve very low vacuum of the order of thousandths of a millimeter, Hg, or several orders of magnitude less, various special types of pump are available. These include mercury diffusion pumps, oil diffusion pumps, turbomolecular pumps, sublimation pumps, ionization pumps and cryopumps. None of these pumps can, by themselves, be used to produce a very high vacuum in a vessel which is initially full of air at atmospheric pressure. To do this, all these high vacuum pumps require the assistance of a backing pump which is able to first prepump the vessel down from atmospheric pressure to a rough vacuum at a pressure at which the particular type of high vacuum pump being used can begin to exert a pumping function.

BACKGROUND ART

At present, prepumping to a rough vacuum (or backing vacuum as it is often called) is usually carried out with an oil-sealed rotary pump which is both lubricated and sealed with hydrocarbon or fluorocarbon oil. Some of the oil molecules are degraded and fragmented into smaller molecules during the operation of the rotary pump and these small hydrocarbon and fluorocarbon molecules exhibit a high vapour pressure relative to that of the oil before the latter was used in the pump. It is difficult to prevent these small molecules from passing back from the pump and entering the vacuum vessel where they contaminate all the surfaces of the vessel and its contents by coating them with an adherent oily film.

In the more modern electron microscopes, in which the specimen is not heated by the electron beam to the extent that it was in earlier types of electron microscopes, oil vapour arising from the oil lubricated pumping system condenses to form a contamination on the specimen, obscuring fine detail and reducing resolution by acquiring an electrical charge which deflects the electron beam. Furthermore, in the scanning transmission type of electron microscope which is now in use, the electron beam is produced from a tungsten tip by field emission, and the presence of any oil vapour in the surrounding vacuum will seriously affect the stability of the electron beam current.

In the technology of producing integrated silicon chip circuits in a high vacuum environment, the presence of any oil vapour is likely to render the chip inoperative because of the deposition of a thin oil film which may prevent good contact between layers and may insulate segments which are intended to be electrically connected.

In these fields, and others, oil lubricated pumps have continued to be used but elaborate systems have been developed for condensing out oil vapour or otherwise preventing it from reaching critical sites. One such system utilises a trap filled with pellets of alumina or zeolite, or a trap maintained at liquid nitrogen temperature; in the pumping line connecting the backing pump with the high vacuum pump. However, these traps are never completely effective in condensing out the oil vapour, so some contamination of the vessel with oily vapour always occurs.

At present, the only oil-free pumps capable of prepumping a vessel down from atmospheric pressure to fractions of a mm Hg are sorption pumps but the use of these is time-consuming and expensive. Sorption pumps usually consist of a stainless steel canister filled with zeolite pellets which, when cooled to liquid nitrogen temperature, have the ability to absorb most atmospheric gases. The canister is first heated and pumped with a backing pump (which needs to be fitted with an oil trap) to remove air from the zeolite pellets. It is then removed from the backing pump, connected to the vessel to be evacuated and then cooled to liquid nitrogen temperature, whereupon it begins pumping and continues to do so until the zeolite becomes saturated with air. The pump must then be disconnected from the vacuum vessel and reprocessed by heating and pumping and again cooling with liquid nitrogen. Sorption pumps were invented to provide oil-free prepumping of systems which are to be evacuated to a very high vacuum by oil-free pumps such as sublimation pumps, ionization pumps or cryopumps. Despite the cost of the liquid nitrogen used for cooling them and the inconveniences involved in processing them, they are widely used for such purposes.

Those oil-free mechanical vacuum pumps which are commercially available are quite incapable of producing high vacuum. Two existing commercial pumps of this type employ split polytetrafluoroethylene (PTFE) sealing rings backed by a split, spring-steel band. The claimed performance of these pumps against atmosphere is 23 mm Hg (absolute) in one case and 124 mm Hg (absolute) in the other, and a clear limiting factor on performance is the split in the steel band which would allow a degree of air leakage. As backing pumps, the utility of these pumps in the applications discussed above is limited to prepumping prior to the use of sorption pumps.

A further mechanical oil-free pump developed by the present applicant is disclosed in Australian Pat. No. 481072. This pump was found capable of producing high vacuum conditions without the use of lubricating and sealing oil but the vacuum which could be achieved was limited by difficulties in sealing against gas leakage into the working space of the pump and by the need to have valves which had to be subjected to gas pressure to open. The vacuum which could be produced in the high vacuum stage of a multi-stage pump was then determined by the pressure required to open an exhaust valve in the high vacuum stage of the pump.

Improvements which have proven successful in meeting these difficulties are disclosed in Australian Pat. No. 516210 and in co-pending Australian patent application No. 68083/81. According to Pat. No. 516210 gas passes from a cylindrical working space above the piston to an annular working space below the piston by way of a gas transfer passage opening at the end face of the cylinder above the piston. Patent application No. 68083/81 discloses alternative sealing ring assemblies which have proven especially effective in enhancing the sealing of the cylinder.

DISCLOSURE OF THE INVENTION

It has now been surprisingly found that the performance of the pump disclosed in the aforementioned patents and patent application can be sustained, and even improved, but with substantial simplification in construction and marked piston mass economy, by certain alternative modifications of the pump first disclosed in Pat. No. 481072. In one respect, it has been discovered that, contrary to earlier practice, it is possible to replace at least some of the sealing rings by circumferentially continuous sleeves of a low-friction material, while, in a separate respect, it is proposed to avoid the limitations previously set by the pressure required to open the exhaust valve by providing simple means for mechanically opening the valve. The first of these proposals has broad application to reciprocatory piston and cylinder machines.

It will be appreciated that, in an oil-free high vacuum application, a split sleeve of low-friction material cannot provide satisfactory sealing means in view of the inevitable leakage along the split. However, replacement of the sealing rings by one or more simple circumferentially continuous sleeves of a low-friction material, such as filled polytetrafluoroethylene (PTFE), is not of itself a practical substitution. It is not generally possible to reduce the rate of leakage past the sleeve to an acceptable level without reducing the gap about the sleeve to a size at which seizure will occur between the sleeve and cylinder wall. Normal operational rises in temperature from ambient will typically embrace at least one of the transition temperatures for a material such as PTFE: the resultant proportional expansion of the order of 1% will not seriously increase the thickness of the sleeve, but will increase its diameter by a very significant amount in relation to the gap about the sleeve, indeed sufficient to cause seizure where the gap is small enough to prevent undue leakage. In accordance with the invention, in its first aspect, it has been realized that these difficulties can be resolved, and a novel means provided for achieving oil-free sealing, by mounting the sleeve on the piston under circumferential tension.

In its first aspect, the invention broadly provides a reciprocatory piston and cylinder machine comprising a cylinder, a cylindrical piston relatively slidably reciprocable within the cylinder, and means for substantially sealing the annular space between the piston and cylinder in lieu of oil or other liquid lubricant , wherein said sealing means comprises a sleeve of a low-friction material disposed under circumferential tension on the cylindrical surface of the piston.

Advantageously, the sleeve remains under circumferential tension over the whole of the temperature range encountered during normal operation of the machine as a vacuum pump.

The sleeve may also be under longitudinal tension, in which case the inner edge of the sleeve may be substantially flush with the adjacent end of the piston.

According to one embodiment of the invention, there is provided a reciprocatory piston and cylinder machine adapted for use as a vacuum pump, comprising:

a cylinder having a first portion closed at one end and a second portion contiguous with, but of smaller diameter than, the first portion;

a piston having a cylindrical head portion slidable in the first cylinder portion and a second cylindrical piston portion slidable in the second cylinder portion, said piston head portion having a front face facing the closed cylinder end and an annular back face;

a gas inlet for inlet of gas to the interior of the first cylinder portion between the front face of the piston head portion and the closed cylinder end on reciprocation of the piston;

a first exhaust port for exhaustion of gas from the interior of the first cylinder portion ahead of the piston head portion by pumping action of the front face of the piston head portion;

a one-way valve in said first exhaust port operable to permit exhaustion of gas from the interior of the first cylinder portion ahead of the piston head portion;

a second exhaust port for exhaustion of gas from the interior of the first cylinder portion behind the piston head portion by pumping action of the back face of the piston head portion; and respective means for substantially sealing the annular space between said cylindrical piston portions and the respective cylinder portions in which they are slidably reciprocable, in lieu of oil or other liquid lubricant;

wherein said sealing means for the piston head portion includes a sleeve of a low-friction material disposed under circumferential tension on the cylindrical surface of the piston head portion and wherein the sleeve remains under circumferential tension over the whole of the temperature range encountered during normal operation of the machine as a vacuum pump. The sealing means for the second piston portion preferably includes a second sleeve of low-friction material disposed under circumferential tension on the cylindrical surface of the second piston portion.

The or each sealing sleeve may be mounted under tension on the piston, for example by heating the sleeve to a temperature sufficient to expand the sleeve for placement about the piston. On cooling, the sleeve will contract and so be mounted under tension. Alternatively, the sleeve may be bonded to the piston under circumferential tension by being sintered on, or deposited by plasma spraying or ion beam sputtering.

For certain applications, the machine may include a sealing ring element about said cylindrical surface of the piston, at or adjacent an end of the sleeve, and means biasing the sealing ring element into sliding contact with the cylinder.

This element may be separate, but is preferably integral with the sleeve and constitutes a terminal portion of the sleeve.

A preferred material for the sleeve(s) is a polytetrafluoroethylene (PTFE) or a filled polytetrafluoroethylene but one may employ any other material which has an appropriate co-efficient of friction and is suitable for the application at hand.

In a second aspect of the invention, there is provided a reciprocatory piston and cylinder machine, comprising:

a cylinder having a first portion closed at one end and a second portion contiguous with, but of smaller diameter than, the first portion;

a piston having a head portion slidable in the first cylinder portion and a second piston portion slidable in the second cylinder portion, said piston head portion having a front face facing the closed cylinder end and an annular back face, a gas inlet for inlet of gas to the interior of the first cylinder portion between the front face of the piston head portion and the closed cylinder end on reciprocation of the piston;

a first exhaust port for exhaustion of gas from the interior of the first cylinder portion ahead of the piston head portion by pumping action of the front face of the piston head portion;

a one-way valve in said first exhaust port operable to permit exhaustion of gas from the interior of the first cylinder portion ahead of the piston head portion but closable against reverse gas flow; and a second exhaust port for exhaustion of gas from the interior of the first cylinder portion behind the piston head portion by pumping action of the back face of the piston head portion;

wherein the one-way valve and/or piston head portion are structured so that, as the front face of the piston head portion approaches the closed cylinder end, the piston head portion physically moves the one-way valve so as to open the first exhaust port.

In a preferred arrangement, the one-way valve includes structure which, in the closed position of the valve, projects inwardly of the closed cylinder end so as to be engagable by the front face of the piston head portion as it approaches the closed cylinder end. There is advantageously provided a passage communicating said first exhaust port downstream of its one-way valve with a port which opens into the interior of the first cylinder portion behind the piston head portion, at least during part of the piston's travel.

BRIEF DESCRIPTION OF THE DRAWINGS

The invention will be further described, by way of example only, with reference to the accompanying drawings, in which.

MODES FOR CARRYING OUT THE INVENTION

Figure 1:
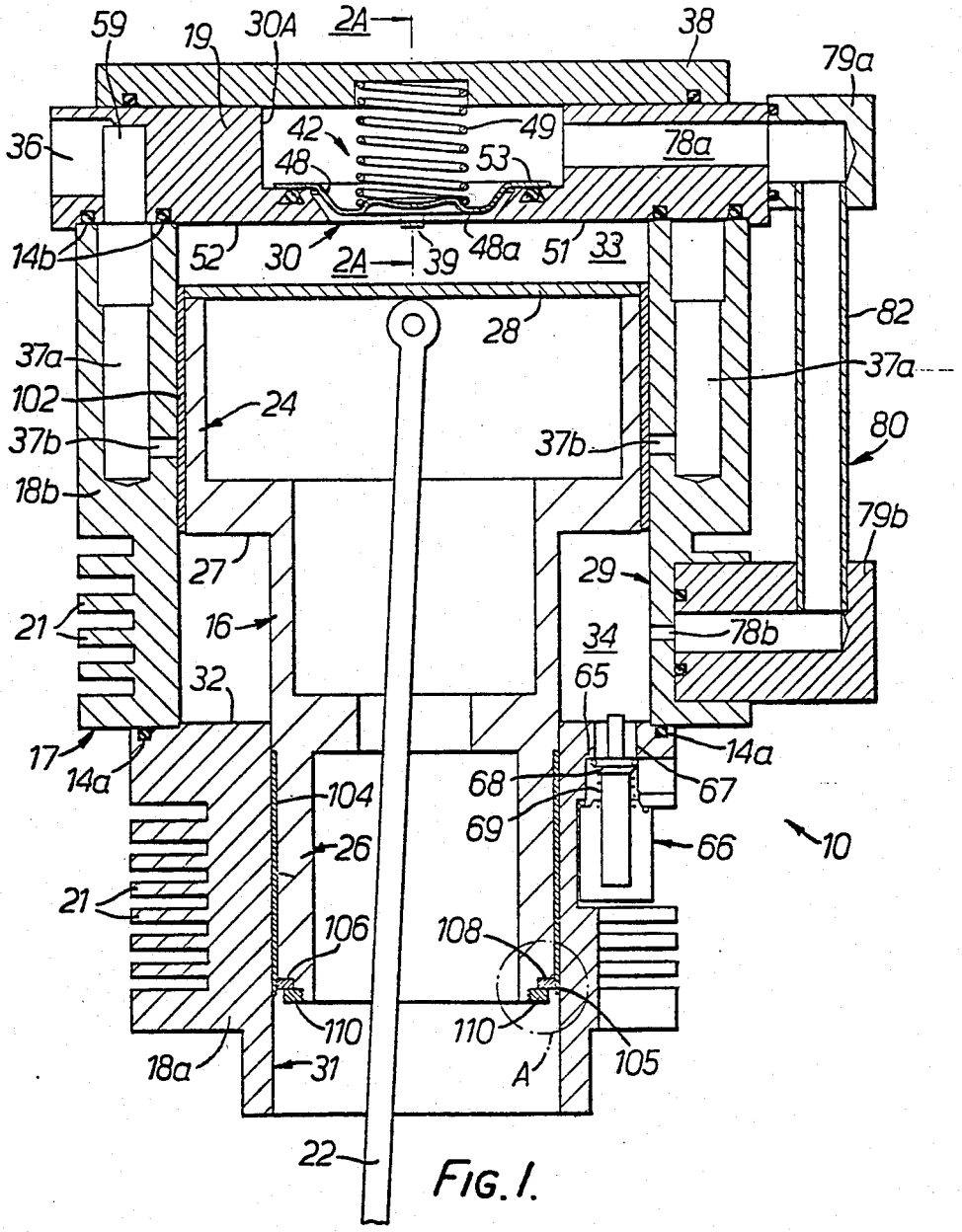
FIG. 1 is an axially sectioned elevation of a single-stage oil-free piston and cylinder machine constructed in accordance with the invention.

The reciprocatory piston and cylinder machine 10 depicted in FIG. 1 is intended to be employed as a high performance backing vacuum pump and as such will be hereinafter referred to as vacuum pump 10. Pump 10 includes a piston 16 which is reciprocated by connecting rod 22 within a cylinder 17 of three part construction, including a smaller diameter peripheral wall 18*a*, a larger diameter peripheral wall 18*b* and a cylinder head 19. The walls 18*a*, 18*b* are clamped together co-axially and end-to-end (by means not shown) on a sealing ring 14*a* and are provided with integral cooling fins 21. Head 19 is fastened (again by means not shown) onto wall 18*b*, with a pair of interposed sealing rings 14*b*.

Piston 16 and cylinder 17 are both of stepped configuration. More particularly piston 16, which is hollow, has a relatively large diameter head portion 24 and a smaller diameter rear skirt portion 26 so that an annular piston face 27 is defined at the rear of the head portion directed oppositely to the main piston face 28. Cylinder 17 has a relatively large diameter portion 29 bounded by wall 18*b*, within which the head portion of the piston slides, and a portion 31 contiguous with, but of smaller diameter than, portion 29, to receive piston skirt portion 26. An annular shoulder 32 is defined by the cylinder between cylinder portions 29, 31 in opposition to the annular piston face 27. Thus, a differential piston arrangement is provided whereby the cylinder has a front cylindrical working space 33 and a rear annular working space 34.

Cylinder head 19 has a gas inlet 36 which provides communication with the interior of the cylinder through an annular manifold 59, multiple longitudinal ducts 37*a* in cylinder wall 18*b*, and a set of inlet ports 37*b* extending through the internal peripheral surface of the cylinder at a location such that they are exposed only when the piston is near bottom dead centre and are covered by the piston during the greater part of its movement.

Differential piston face 27 acts to exhaust air from working space 34 via an exhaust port 67 at shoulder 32 extending parallel to the axis of the pump through cylinder wall portion 18*a*. Exhaust port 67 is fitted with a one-way valve 66 comprised of a valve plug 68 and a valve biasing spring 69. Plug 68 seats on a sealing ring disposed on an opposing shoulder 65 in the port.

Cylinder head 19 is provided with a further exhaust port 30 which also carries a one-way valve 42 in a counter bore 30*a* formed within the head. This valve (FIGS. 2 and 3) is comprised of a dished valve plate or disc 48 the rim of which is biased by a helical compression spring 49 onto an O-ring 53 set into the outer surface of an annular flange 51 about port 30. Spring 49 acts directly between a closure plate 38 and valve disc 48. Disc 48 is fastened to the head by an integral projecting tab 47 which includes a thinned hinge portion 47*a* about which the valve disc may rise against spring 49. Disc 48 has an annular land 48*a* which lies within but does not project through port 30 and is bridged by a domed strap 39 of slightly flexible spring metal. Strap 39 is fixed at one end 39*a* to land 48*a* but is only in slidable contact with land 48*a* at its other end 39*b*. The domed central portion of strap 39 projects through port 30 and extends slightly inwardly of face 52 when the valve is in the closed position. It will be seen that, as the front face of piston head portion 24 approaches end face 52 of cylinder head 19 , it will engage strap 39 and lift the rim of disc 48 off O-ring 53 to thereby open the port. The ability of strap 39 to slightly flex and slide at one end across land 48*a* aids in minimising any repetitious contact noise.

Figure 2A:
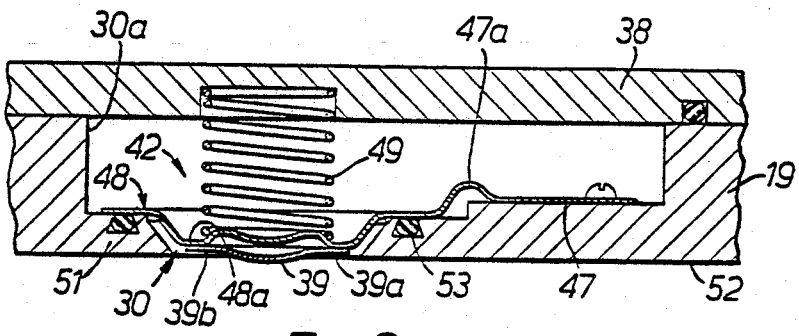
FIG. 2A is a cross-section on the line 2A—2A in FIG. 1.
Figure 2B:
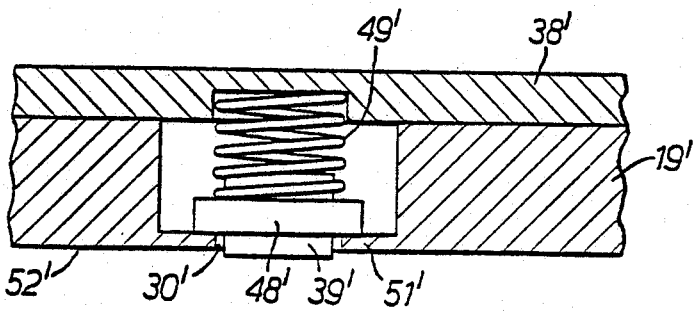
FIG. 2B is a view similar to FIG. 2A but showing an alternative construction of one-way valve.
Figure 3:
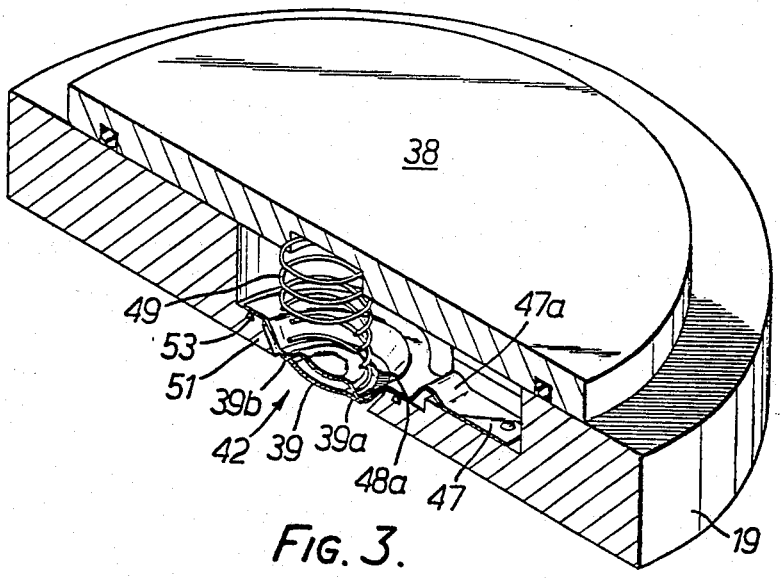
FIG. 3 is a sectioned perspective view showing the detail of FIG. 2A.

An alternative design of one-way valve is depicted in FIG. 2B, in which like reference numerals indicate like or corresponding parts with respect to FIG. 2A. In this construction the valve is comprised of an elastomeric valve plate or disc 48' biased by a helical valve spring 49' against a thin annular flange 51' formed in cylinder head 19' to project inwardly of port 30' at the inner face of cylinder head 19'. Spring 49' acts directly between a closure plate 38' and valve disc 48'. The face of disc 48' which is presented to flange 51' has a central projecting boss portion 39' which projects through and almost fills the rim of flange 51', and extends inwardly of face 52' when the valve is in the closed position. It will be seen that as the front face of piston head portion approaches face 52', it will engage boss portion 39' and lift disc 48' off flange 51' to thereby open the port.

Provision is made to clear gas from the space behind disc 48 into the working space 34. Specifically, a radial passage 78*a* from port 30 behind disc 48, and a small port 78*b* into working space 34 near exhaust port 67 are placed in communication by of ducting 80 to form an external transfer passage. Ducting 80 includes respective hollow caps 79*a*, 79*b* for passage 78*a* and port 78*b*, and a tube 82 connecting the interiors of these caps.

The piston portions 24, 26 are provided with respective means for substantially sealing the annular space between the piston portions and the respective cylinder portions 29, 31, in lieu of oil or other liquid lubricant.

The sealing means for piston head portion 24 comprises a sleeve 102 of bronze-filled poly tetrafluoroethylene (PTFE) or similar disposed under circumferential tension and longitudinal tension on the cylindrical surface of the piston head portion. Filled PTFE is a widely used low-friction plastics material. Sleeve 102 is about 1 mm thick and may be fitted onto the piston in any suitable manner. A convenient technique is to heat the sleeve to a temperature, high enough to gain sufficient thermal expansion of the sleeve to allow it to be pushed over the piston head portion. On subsequent cooling, the sleeve contracts but its initial internal diameter is selected to be marginally smaller than the external diameter of the piston so that, under static cool or normal operational conditions, the sleeve is under circumferential tension on the piston. For example, for filled PTFE the internal diameter of sleeve 102, at 20° C. prior to application to or on removal from the sleeve, is chosen to be between about 0.95 and about 0.98, most preferably between 0.970 and 0.975 of the external diameter of piston head portion 24. A difference less than 2% is not adequate, since expansion of PTFE in the region between 19° C. and 30° C. which is likely to be reached during normal pump operation, entails an increase in diameter of over 1%.

It is found that the gap about sleeve 102 can be reduced to a size at which leakage past the sleeve is at an acceptable level, without incurring seizure between the sleeve and the cylinder wall. Normal operational rises in temperature from ambient will typically embrace at least one of the transition temperatures of filled PTFE: the resultant proportional increase of 1 to 2% in the diameter of an untensioned sleeve would normally be sufficient to cause seizure where the gap is small enough to prevent undue leakage. However, it is found that there is a range of practical gap sizes at which leakage is at an acceptable level but at which seizure does not occur under normal operation of the pump., Experiments have proved that the tendency to diametral thermal expansion is sufficiently countered by the circumferentially tensioned state of the sleeve. Filled PTFE contains numerous small interstices which open to some degree as the applied sleeve cools and during the subsequent warming which accompanies operation these interstices contract and so prevent overall expansion of the material.

The discussion thus far has emphasized circumferential tension in the sleeve. As mentioned, the sleeve is also under longitudinal tension: this occurs naturally on cooling of the sleeve after its application to the piston because of friction between the sleeve and the relatively rough underlying piston surface as the sleeve comes under circumferential tension. The advantage of longitudinal tension is that the edges of the sleeve remain substantially flush with the ends of the piston head portion 24, as illustrated,during operation of the pump so that dead space can be minimised.

It is further found that the rate of wear of the sleeve 102 is markedly less than might be expected from experience with conventional sealing rings of a like material. As the wear rate depends upon both the mutual pressure and relative velocity of the contacting components, it is evident that the observed low rate of wear also arises from the circumferentially tensioned state of the sleeve, such state counteracting expansion and thereby reducing the effect of the pressure contribution to the wear rate.

Figure 4:
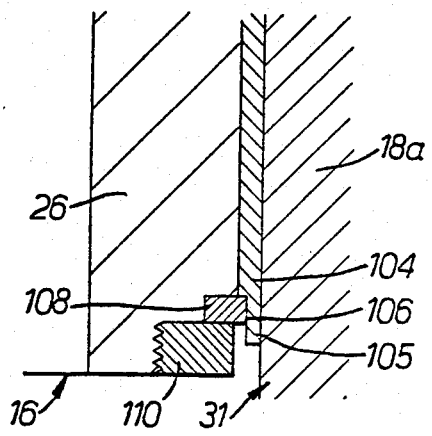
FIG. 4 is an enlargement of region A of FIG. 1.

The sealing means for the smaller diameter piston portion 26 also comprises a bronze-filled PTFE sleeve 104 mounted on the piston in a similar manner and under similar conditions to the sleeve 102., It is a matter of experience that the sleeve alone may not be sufficient to ensure an adequate sealing of the working space 34, in a situation where the pressure gradient to the exterior is substantial. This situation typically applies to the sleeve 104. For this reason, it is preferred to bias an annular terminal element 105 (FIG. 4) of sleeve 104 against the cylinder wall by means of an elastomeric filler 106 or other expander means, e.g. a split spring-steel band, retained in a rebate 108 by an annular threadably secured keeper 110. In an alternative construction, instead of placing elastomer 106 under an annular element of sleeve 104, it may be preferred to provide a low-friction sealing ring as a separate element adjacent to an end of sleeve 104.

The material of sleeves 102, 104 may be selected from low-friction media, including various other fluorocarbon plastics so as to have an appropriate coefficient of friction and to be generally suitable for the application at hand. Filled PTFE is found to afford highly satisfactory performance as is suitable for a vacuum pump application since outgassing under low pressures is not significant. The thickness of the sleeves may be substantially less than or more than the 1 mm indicated above, as dictated by the required performance of the sleeve and the technique of application but a thickness of at least about 0.2 mm, is preferred. The preferred upper limit is found to be about 2 mm, since greater thicknesses tend to require an annular gap of a size at which sealing performance is diminished.

Aside from the simplicity of manufacture, another important advantage accrues from the use of sealing sleeves 102, 104 in place of the conventional sealing rings. Specifically, the total metal volume and mass of the piston 16, which is typically aluminium, can be reduced, by as much as half, since the walls of the piston need not be as thick to accommodate grooves and rebates for mounting sealing ring assemblies. The consequent reduced mass of the reciprocating components materially lessens vibration.

The described arrangement has been advanced merely by way of explanation and many modifications may be made thereto without departing from the spirit and scope of the invention as defined in the appended claims. It is especially emphasized that the provision of the low-friction sealing sleeve under tension is not confined to the particular machine illustrated and described herein, nor to vacuum pumps in general. It is applicable to most oil-free reciprocatory piston and cylinder machines. Moreover, the particular technique of applying the sleeve to the piston is not material to the invention. While one such technique has been outlined herein, others may be employed, e.g. direct coating by sintering or other depositions of successive layers, such as plasma spraying or ion beam sputtering.

We claim:

1. An ail free reciprocatory vacuum pump, comprising:

a cylinder having a first portion closed at one end and a second portion contiguous with, but of smaller diameter than the first portion;

a piston having a first hollow, metallic cylindrical head portion relatively slidable in the first cylinder portion and a second hollow, metallic piston portion relatively slidable in the second cylinder portion, said first piston head portion having a front face facing the closed cylinder end and an annular back face;

a gas inlet in said cylinder for inlet of gas to the interior of the first cylinder portion between the front face of the piston head portion and the closed cylinder end on reciprocation of the piston with said piston acting as a valve member to control the flow of gas through said gas inlet;

a first exhaust port for exhaustion of gas from the interior of the first cylinder portion ahead of the piston head portion by pumping action of the front face of the piston head portion;

a first one-way valve in said first exhaust port operable to permit exhaustion of gas from the interior of the first cylinder portion ahead of the piston head portion;

a second exhaust port for exhaustion of gas from the interior of the first cylinder portion behind the first piston head portion by pumping action of the back face of the first piston head portion;

a second one-way valve in said second exhaust port;

a passage by which gas may be passed from the interior of the first cylinder portion ahead of the piston head portion to the interior of the first cylinder portion behind the piston head portion; and, respective sealing means for substantially sealing the annular space between said cylindrical piston portions and the respective cylinder portions in which they are slidably reciprocable, in lieu of oil or other liquid lubricant;

characterized in that said sealing means for the first piston head portion includes a first sleeve of a low friction material disposed on the cylindrical surface of the first piston head portion, such that, over the temperature range encountered during normal operation of the pump, a mean gap is sustained about the sleeve between the sleeve and the cylinder, which gap is of a maximum size at which leakage of gas past the sleeve is at a level acceptable for a vacuum to be sustained by the pump;

said sealing means for the second piston portion includes a second sleeve of low friction material disposed on the cylindrical surface of the second piston portion, such that, over the temperature range encountered during normal operation of the pump, a mean gap is sustained about the sleeve between the sleeve and the cylinder over substantially the entire surface of the sleeve and a sealing ring element about said cylindrical surface of the second piston portion, at or adjacent an end of the second sleeve remote from said first piston portion, and means biasing the sealing ring element into sliding contact with the second cylinder portion.

2. A reciprocatory vacuum pump according to claim 1 further characterized int hat the sealing ring element is integral with the second sleeve and constitutes a thermal portion of the second sleeve.

* * * * *